US006179050B1

(12) United States Patent
Dey et al.

(10) Patent No.: US 6,179,050 B1
(45) Date of Patent: Jan. 30, 2001

(54) HEAT EXCHANGERS

(75) Inventors: LaVoyce Dey, Youngsville, PA (US); James Koo, East Amherst, NY (US)

(73) Assignee: Valeo Thermique Moteur, La Verriere (FR)

( * ) Notice: Under 35 U.S.C. 154(b), the term of this patent shall be extended for 0 days.

(21) Appl. No.: 09/408,342

(22) Filed: Sep. 29, 1999

(51) Int. Cl.[7] ..... F28D 1/00
(52) U.S. Cl. ..... 165/149
(58) Field of Search ..... 165/149, 906

(56) References Cited

U.S. PATENT DOCUMENTS 1,743,785 * 1/1930 Leszczyk ..... 165/149
4,433,227 * 2/1984 Brittin ..... 219/10.41
4,738,308 * 4/1988 Moranne ..... 165/149
4,745,966 * 5/1988 Avery ..... 165/906
5,791,402 * 8/1998 Dumetz ..... 165/149

FOREIGN PATENT DOCUMENTS

2064751 * 6/1981 (GB) ..... 165/149
2418132 * 6/1981 (DE) ..... 165/149
2098313 * 11/1982 (GB) ..... 165/149

* cited by examiner

*Primary Examiner*—Ira S. Lazarus
*Assistant Examiner*—Tho Duong
(74) *Attorney, Agent, or Firm*—Morgan & Finnegan, LLP

(57) ABSTRACT

A sideplate for a heat exchanger has a double-folded flange on both sides of an elongate web portion. The sideplate has braze cladding on one side only, to prevent discoloration problems during brazing.

21 Claims, 2 Drawing Sheets

14
12
4
16
10
8
14
16
18
II
II'
24
18
2
20
6
22

14
16
32
24
30
21
20
31
22
23
26
33
18

HEAT EXCHANGERS

FIELD OF THE INVENTION

The present invention relates to a sideplate for a heat exchanger and a heat exchanger.

BACKGROUND OF THE INVENTION

Heat exchangers for vehicles are known to have a header and a tank connected by tubes interspaced by fins, with sideplates providing rigidity. In this type of heat exchanger the fins provide a large surface area for heat transfer and support for the tubes.

Such heat exchangers may be used as radiators or condensers. They may also be used in a number of other applications including charged air coolers.

The sideplates are of particular importance during construction and handling of a heat exchanger. The sideplates may be used to gather the fins and tubes to form a heat exchanger core before securing the core to a header manifold and a tank manifold. Since it is preferable to provide the outermost tubes with fins on their outer edges to ensure good heat transfer, the sideplates may be attached to each of the outer fins.

After assembling the core assembly with the header manifold and the tank manifold, the resultant assembly is brazed in an oven. In the oven, braze cladding coated onto the components melts so that upon cooling, the components are secured together. Sideplates, as is known in the art, can be in a variety of shapes. For example, a sideplate may be a flat elongate plate or a plate curved at either side of an attachment surface. Sideplates may also have strengthening ribs. Suitable materials for sideplates include aluminum or aluminum alloys.

For production reasons, the assemblies are often put in the oven with the tubes positioned in the horizontal. A first problem which may arise with such positioning is "fin drop" which occurs between the fins and the sideplate during the oven melt period. In this condition, the fin begins to move from a symmetrically centered position relative to the sideplate center to an offset position. As a result, the core face edge of the fin is lower than the normal core face on one side and above the normal core face on the opposite side. Fin drop occurs when the force of gravity is greater than the residual friction force at the fin tip area that contacts the tubes and sideplate.

Radiator fins have been made which curl over the end radius of the tube. However, these fins do not always effectively prevent fin drop. Other fins use a bake framing member running close to the fin surface to prevent fin drop, but this can cause discoloration on the core surface or cratering if a clad build up is present.

A second problem is that of "fin dissolution". The brazing process has to be carried out in a reducing atmosphere to avoid production of metal oxides that would weaken the brazed joints. Unfortunately, during an effective reducing-atmosphere brazing process, the nature of the cladding is such that it causes diffusion of the adjacent material (i.e., the outer fins), which weakens the fin material and therefore the structural stability of the heat exchanger.

A third problem is that the materials of a bake frame, often comprising straps or wires, cause discoloration when in close proximity to cladded surfaces. Furthermore, if the frame material is in contact with the sideplates, the clad material tends to gather near the point of contact. This condition is known as "cratering" and results in marks on the surface of the sideplates. These phenomena reduce the aesthetic qualities of the heat exchanger.

It is accordingly an object of the present invention to at least partially mitigate the problems of the prior art.

SUMMARY OF THE INVENTION

According to a first aspect of the present invention there is provided a sideplate for a heat exchanger comprising an elongate generally planar web portion, two inner side wall portions and two outer side wall portions. The web portion extends into said inner side wall portions, each said inner side wall portion extending at a respective extremity thereof into a respective outer side wall portion. The inner and outer side wall portions extend out of the plane of the web portion, and at least one of said outer side wall portions extends beyond the web portion.

Preferably each said inner side wall portion extends substantially perpendicular to the planar web portion and has an outer face, and each said outer wall portion lies along the outer face of a respective inner side wall portion.

Advantageously the outer face of said inner side wall portion is contiguous with an outer face of the web portion, and the side plate further has a braze clad material disposed on the outer face of the web portion.

Preferably the braze clad material is disposed only on the outer face of the web portion.

According to a second aspect of the invention there is provided a heat exchanger comprising a header, a tank, a plurality of tubes arranged to connect the header and the tank, a plurality of fins for interspacing the tubes. The fins extend along the length of the tubes, and have at least one outermost tube, which has an outer edge with a first fin. The heat exchanger further comprises a sideplate extending between said header and said tank and having a web portion engaging said first fin, the sideplate having braze cladding on one face of said web portion. The web portion has a thickness, and the sideplate has a flange of double said thickness that extends beyond said web portion to form a fin support portion.

According to a third aspect of the invention there is provided heat exchanger comprising a first manifold having a length and transverse width, a second manifold, a heat exchanger core having a thickness less than said transverse width, and a sideplate disposed between said manifold. The core comprises a plurality of tubes and a plurality of fins, wherein said tubes comprise at least one outermost tube having an outer edge, said outermost tube having a first fin on its outer edge. The sideplate is disposed between the manifolds and has a web portion having one face engaging said first fin, braze cladding being disposed on said one face. The sideplate also has a first portion with a first width substantially equal to said core thickness, and a second portion with a second width greater than said first width. The web portion has a first thickness and the second portion of the sideplate has a flange of double said first thickness, the flange extending beyond the web portion to form a fin support portion.

DESCRIPTION OF THE PREFERRED EMBODIMENTS

Figure 1:
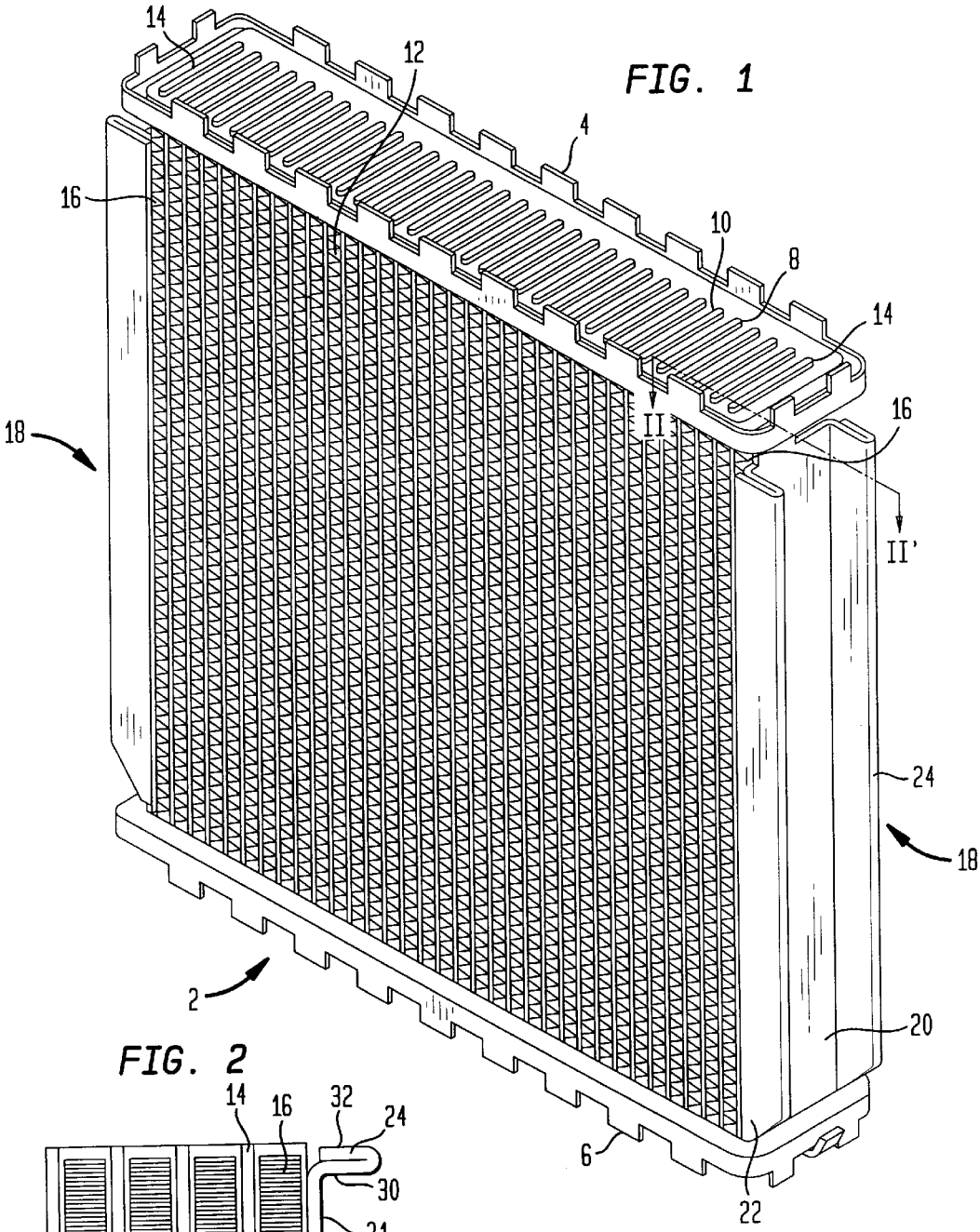
FIG. 1 shows a perspective view of a part of a heat exchanger with sideplates according to a preferred embodiment of the present invention.

In the drawings like reference numerals indicate similar parts.

Figure 6:
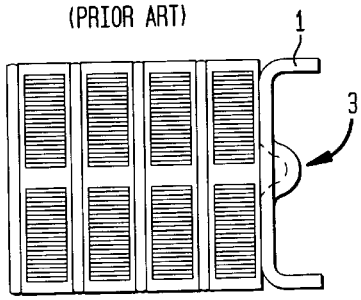
FIG. 6 (PRIOR ART)
FIG. 6 is a partial sectional view through a heat exchanger with a sideplate according to the prior art.

FIG. 6 shows a partial cross-section of a heat exchanger of the prior art. The heat exchanger comprises a generally C-shaped sideplate 1 which is formed from a single sheet of material bent in a single thickness at either side. The side plate thus has two opposing side walls spaced by a straight base wall. The heat exchanger may also comprise a strengthening rib 3 formed by bending the material of the sideplate away from the heat exchanger.

Figure 2:
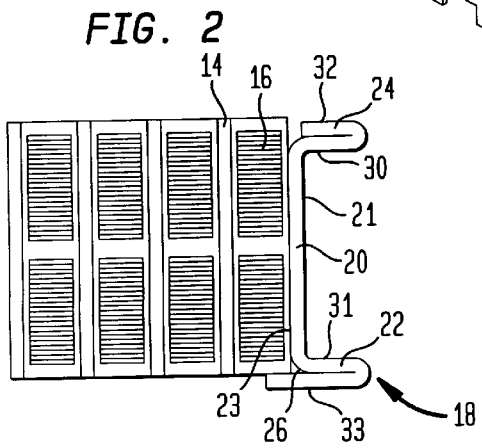
FIG. 2 is a sectional view through the line II–II' of FIG. 1 showing the sideplate viewed looking downwards on the header.

Referring to FIGS. 1 and 2, a heat exchanger core 2 for a vehicle is shown secured to a top manifold 4 and a bottom manifold 6. The core consists of a plurality of tubes 8 spaced by fins 12, 14 and opposing side plates 18. The manifolds are disposed parallel to one another, the tubes 8 connecting the manifolds and perpendicular to the manifolds. The tubes have a narrow rectangular cross-section (with rounded corners) such that the tubes have two flat sides 10. Interspaced between the flat sides 10 of adjacent tubes along substantially the entire length of the tubes are a plurality of serpentine fins 12. There are two outermost tubes 14, each of which have a set of fins 16 on their outer flat sides. These two sets of fins 16 are secured to the sideplates 18, and the sideplates are secured to the top and bottom manifolds 4, 6.

In use, coolant flows through the tubes 8 from a header formed in part by top manifold 4 to a tank formed in part by bottom manifold 6. The fins 12, 16 contact the tubes to provide a large surface area for conducting heat from the coolant. In addition, the fins provide structural support to the tubes 8. This is important since the coolant may be pressurized.

It will be understood that the invention is also applicable to heat exchangers used as charge air coolers, where pressurized air from, for example, a turbocharger, is cooled by passage through the heat exchanger.

Continuing to refer to FIG. 2, each sideplate comprises an elongate generally planar web portion as a base wall 20 which extends at its opposite side extremities into inner side wall portions 30. 31. The inner side wall portions extend substantially perpendicular to the plane of the base wall 20. Both of the inner side wall portions 30, 31 extend substantially the same distance from the plane of the base wall 20 before extending back upon themselves to form respective outer side wall portions 32, 33. The inner side wall portions 30, 31 have outer is surfaces and the outer side wall portions lie along the outer surface of the respective inner side wall portion.

Thus the sideplate has a single thickness base wall with double thickness flange portions 24, 22 extending at either side thereof. The base wall has an outer face 23 contacting the fin 16, and an inner face 21.

As will be seen by further reference to FIG. 2, one of the outer side wall portions 32 reaches only as far the level of the inner face 21 of the base wall 20 whereas the other side wall portion 31 extends beyond the outer face 23 of the base wall 20 to form a fin support portion 26 that runs along the side of the fin 16.

Each sideplate 18 is constructed from a single piece of material, preferably aluminum or aluminum alloy, clad on only one side with braze clad. The clad side corresponds to the outer face 23 of the base wall 20, the outer face of the inner side wall portions, the inner face of the outer side wall portions and the fin support portion. In other words, those faces which contact other faces of the sideplate, or which contact the fin 16 are clad with braze. Those faces of the sideplate which are exposed to view are left unclad.

The sideplate of the invention has several advantages. Firstly, since the flanges are double thickness, they provide better rigidity to the sideplate than would a single thickness flange. This means that a smaller thickness of sideplate material can be chosen, whilst providing the same rigidity and support as a thicker sideplate having flanges of only a single thickness. The reduced thickness gives rise to reductions in material costs.

It may also be possible to reduce the amount of braze clad necessary to braze the sideplate of the invention as compared to prior sideplates. Firstly, where the clad coating is applied by a hot rolled process, the minimum clad thickness is conventionally 3% to 5% of the thickness of the material to which the coating is applied; hence a reduction of the material thickness enables a reduction of the clad thickness. However, the minimum thickness of clad is not determined only by the weight of the material, but also by the necessity to maintain sufficient clad during the core brazing process. In any event, reduction in clad thickness can reduce fin dissolution.

Figure 3:
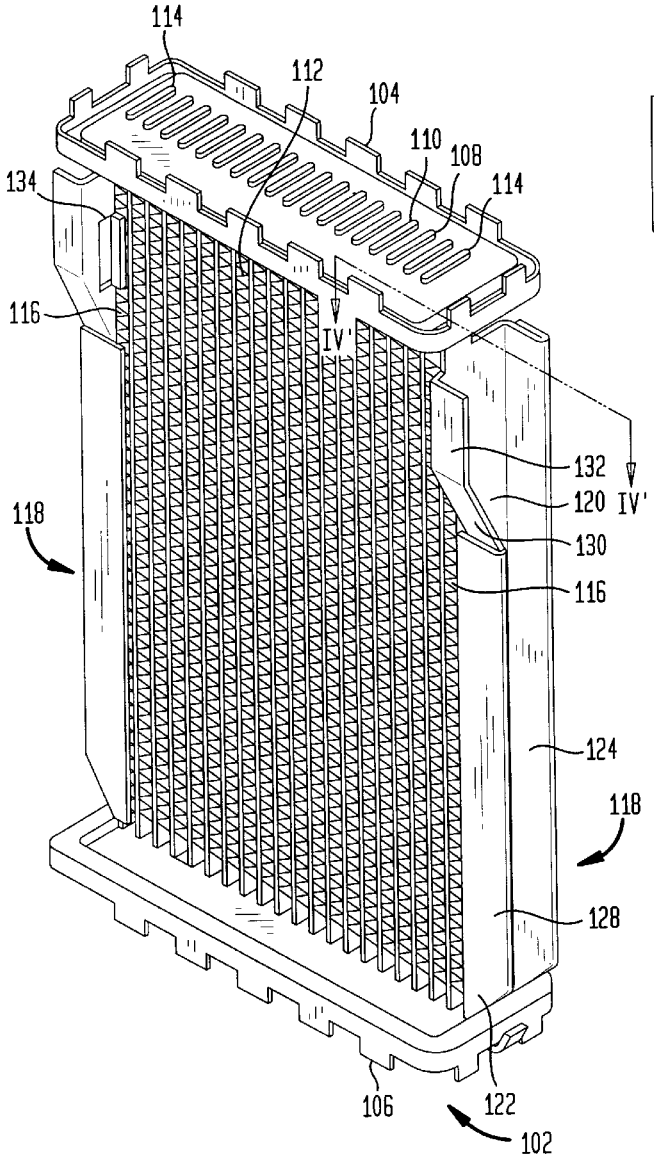
FIG. 3 shows a perspective view of a heat exchanger with sideplates having an offset flange section according to a second preferred embodiment of the present invention.

When the core assembly is held by a braze frame, it can be observed from FIGS. 2 and 3 that the frame is likely to contact only the outer surfaces 21, 32, 33 of the sideplate. It should be recalled that these outer surfaces are not clad-coated. As a result, the cosmetic and mechanical defects that are associated with brazing frames are minimized. However, cladding on the mating surfaces of the inner and outer side wall portions which make up the flanges means that during the brazing process these side wall portions become integrally connected, further strengthening the flanges.

Referring now to FIG. 3, a second heat exchanger has a core thickness which is less than the width of the manifolds. The heat exchanger has a top manifold plate 104 and a bottom manifold plate 106 which are connected by a plurality of tubes 108. The tubes have a narrow rectangular cross-section (with rounded corners) such that they have two flat sides 110. Interspaced between the flat sides 110 of adjacent tubes along substantially the entire length of the tubes are a plurality of serpentine fins 112. There are two outermost tubes 114, which both have a set of fins 116 on their outer sides. These two sets of fins 116 are also attached to sideplates which are indicated generally by 118. Each sideplate has base wall 120 and two flanges 124, 128.

The core is offset rearwardly on the manifolds, as shown in FIG. 3. Each sideplate 118 has a first rear flange 124 that extends in a straight line between the rear of the top manifold 104 3 and the rear of the bottom manifold 106. The front flange 128 has a first region 122 which runs generally parallel to the rear flange 124 for about four-fifths of the length of the sideplate, the spacing between the flanges and the base wall width here being the width of the core.

However, from that point, the base wall of the sideplate tapers outwardly to a width corresponding substantially to that of the top manifold 104 and then extends to the top manifold over a region of constant width. Thus, the front flange 128 has an outward angled region 130 which extends to a top region 132 parallel with the rear flange 124 but spaced from the rear flange by substantially the top manifold width. The rear flange 124 is double thickness, similar to the flanges 24 of the first embodiment.

The first region 122 of the front flange has a folded back portion which extends to form a fin support portion, as described with respect to FIG. 2. The top region 132 of the front flange is a single thickness of the plate material, and in this region the base wall 120 extends forward of the plane defined by the fins 116. Each extended area has a cut out bent backwards to provide a fin support tab 134.

During brazing, when the core is held in a horizontal position with the front flanges 122 underneath, the tabs 134 support the fins 116 toward one end and the fin support portion of the flange 128 supports the fins toward the other end.

The angled region 130 is also a single thickness, folded to provide the required angle.

Figure 4:
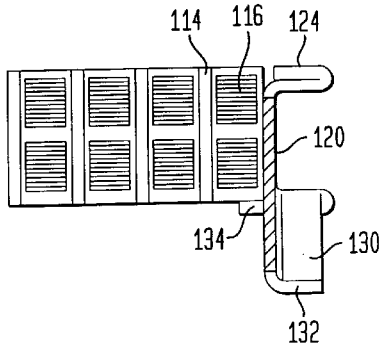
FIG. 4 is a sectional view through the line IV–IV' of FIG. 3 showing the sideplate with an offset flange and a positioning tab, viewed looking downwards on the header.

The arrangement of the second embodiment is illustrated in partial sectional view from above in FIG. 4, which clearly shows the position of tab 134 for providing fin support. It will be understood by those skilled in the art that the embodiment of FIGS. 3 and 4 is brazed with the core spaced from any brazing frame. This embodiment allows large tanks to be used, the tapering-width sideplate providing additional structural support for such tanks, in which case, tapering at both ends is envisaged. Alternatively, a single tank may be substantially wider than the core.

Figure 5:
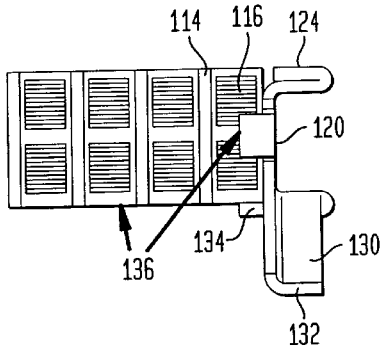
FIG. 5 is a sectional view similar to FIG. 4 showing an alternative sideplate with an offset flange and multiple positioning tabs, viewed looking downwards on the header.

A third embodiment of the invention is illustrated in partial cross-section in FIG. 5. This embodiment is similar to the second embodiment, but is provided an additional tab 136. This tab is attached to the face 120 of the sideplate 118 and is situated in a recess of the fin 116. This design has the advantage over the prior art that as well as providing structural support for the core, it also provides fin support to prevent fin drop.

What is claimed is:

1. A sideplate for a heat exchanger comprising:

an elongate generally planar web portion defining a plane and having two opposing ends, two inner side wall portions, and two outer side wall portions, wherein said web portion extends at each of the opposing ends into a respective one of said inner side wall portions, each said inner side wall portion extending at an extremity thereof into a respective one of said outer side wall portions, said inner side wall portions and said outer side wall portions extending out of the plane of said web portion in a first direction, and at least one of said outer side wall portions extending beyond the plane of said web portion in a second direction.

2. The sideplate of claim 1, wherein each said inner side wall portion extends substantially perpendicular to the plane of said web portion and has an outer face, and each said outer side wall portion lies along the outer face of a respective one of said inner side wall portions.

3. The sideplate of claim 2, wherein said outer face of said inner side wall portion extends to an outer face of said web portion, and wherein said sideplate comprises a braze clad material disposed on said outer face of said web portion.

4. The sideplate of claim 3, wherein each said outer side wall portion has a respective face remote from the respective inner side wall portion, and no braze clad material is disposed on said face.

5. A heat exchanger comprising:

a header:

a tank;

a plurality of tubes arranged to connect the header and the tank;

a plurality of fins for interspacing the tubes, the fins extending along the length of the tubes, wherein the tubes comprise at least one outermost tube, the outermost tube having an outer edge and having a first fin on the outer edge;

a sideplate extending between the header and the tank and having a web portion engaging the first fin, the sideplate having braze cladding on one face of the web portion;

wherein the web portion has a thickness, and the sideplate has a flange of double said thickness, the flange extending beyond the web portion to form a fin support portion.

6. The heat exchanger of claim 5 having a second flange opposing the flange, the second flange having a thickness double said thickness of the web portion.

7. The heat exchanger of claim 6 wherein the sideplate is formed from a single sheet of material, and the flange comprises two layers of the material connected at a fold line.

8. The heat exchanger of claim 5 wherein the heat exchanger is a radiator.

9. The heat exchanger of claim 5 wherein the heat exchanger is a charge air cooler.

10. A heat exchanger comprising:

a first manifold having a length and a transverse width;

a second manifold;

a heat exchanger core having a thickness less than said width, the core comprising a plurality of tubes and a plurality of fins, wherein the tubes comprise at least one outermost tube having an outer edge, the outermost tube having a first fin on the outer edge;

a sideplate disposed between the manifolds and having a web portion having one face engaging the first fin, braze cladding being disposed on the one face, and wherein the sideplate has a first portion having a first width substantially equal to the core thickness and a second portion having a second width greater than the first width; wherein the web portion has a first thickness and the second portion of the sideplate has a flange of double said first thickness, the flange extending beyond the web portion to form a fin support portion.

11. A heat exchanger according to claim 10, wherein a fin support tab extends from the web portion in the first portion of the sideplate.

12. A heat exchanger comprising the sideplate of claim 1.

13. A vehicle comprising the heat exchanger of claim 5.

14. A sideplate for a heat exchanger comprising:

two inner side wall portions, each inner side wall portion having a first end and a second end;

an elongate generally planar web portion extending between the first end of each inner side wall portion; and two outer side wall portions, each outer side wall portion extending from the second end of each inner side wall portions;

wherein the inner side wall portions and the outer side wall portions are substantially parallel to each other, the inner side wall portions and the outer side wall portions extending substantially perpendicular to the web portion in a first direction, and at least one of the outer side wall portions extending perpendicular to the web portion in a second direction.

15. The sideplate of claim 14 wherein each inner side wall portion has an outer face, and wherein each outer side wall portion lies along the outer face of a respective one of the inner side wall portions.

16. The sideplate of claim 15 wherein the outer face of the inner side wall portion extends to an outer face of the web portion, and wherein a braze clad material is disposed on the outer face of the web portion.

17. The sideplate of claim 16, wherein each outer side wall portion has a face remote from the respective inner side wall portion, and no braze clad material is disposed on the face.

18. A heat exchanger comprising:

a header;

a tank;

a plurality of tubes connecting the header and the tank, the plurality of tubes including at least one outermost tube having an outer edge with a first fin;

a plurality of fins extending along the length of and interspacing the plurality of tubes; and a sideplate extending between the header and the tank, the sideplate having a web portion and a first flange, the web portion having a thickness and braze cladding on a first face that engages the first fin, the first flange having double said thickness and extending beyond the web portion to form a fin support portion.

19. The heat exchanger of claim 18 having a second flange opposing the first flange, the second flange having double said thickness of the web portion.

20. The heat exchanger of claim 18 wherein the sideplate is formed from a single sheet of material, and wherein the first flange comprises two layers of the material connected at a fold line.

21. The heat exchanger of claim 18 wherein the heat exchanger is a radiator or a charged air cooler.

* * * * *